US005555785A

United States Patent [19]

Scalise et al.

[11] Patent Number: 5,555,785

[45] Date of Patent: Sep. 17, 1996

[54] PAPER SLITTING DEVICE WITH INTEGRAL SPRING BIASING MEANS

[76] Inventors: William J. Scalise; Donna J. Scalise, both of 10137 Bauer Rd., St. Louis, Mo. 63128

[21] Appl. No.: 317,772

[22] Filed: Oct. 4, 1994

[51] Int. Cl.[6] ..... B26F 1/18

[52] U.S. Cl. ..... 83/589; 83/142; 83/564; 83/599; 16/221; 16/257

[58] Field of Search ..... 83/167, 564, 582, 83/588, 589, 599, 142; 30/234, 279.2, 305; 16/221, 257

[56] References Cited

U.S. PATENT DOCUMENTS 4,656,907 4/1987 Hymmen ..... 83/588 X
4,879,932 11/1989 Scalise et al. ..... 83/30
4,893,535 1/1990 Bentrim et al. ..... 83/589 X
4,941,381 7/1990 Garner ..... 83/589 X
5,056,190 10/1991 Rock et al. ..... 16/257 X

*Primary Examiner*—Eugenia Jones
*Attorney, Agent, or Firm*—Grace J. Fishel

[57] ABSTRACT

A paper slitting device having first and second pivotally mounted platens with an integral biasing spring between them. The spring is formed by a resilient member extending from the first platen toward the second platen. The resilient member has a free end that is received in slots provided in the second platen and forms a bearing for the first platen and bending about an axis when a force is applied to one of the platens sufficient to move the one platen towards the other platen. The resilient member then returning the one platen to an at rest position when the force is removed.

5 Claims, 3 Drawing Sheets

PAPER SLITTING DEVICE WITH INTEGRAL SPRING BIASING MEANS

BACKGROUND OF THE INVENTION

1. Field of the Invention

The present invention relates to a paper slitting device having first and second pivotally mounted platens with an integral spring biasing means interposed therebetween.

2. Brief Description of the Prior Art

U.S. Pat. No. 4,879,932 describes a manually operable paper slitting device for slitting diagonally extending and spaced apart parallel slits in paper for the insertion of a business card or the like. For the purpose of lowering manufacturing costs, it would be desirable to reduce the number of separate parts. More particularly in U.S. Pat. No. 4,879,932, a spring means resiliently biases first and second pivotally mounted platens away from each other, the first platen being provided with spaced slitting blades extending from the first platen toward the second platen and cooperating with spaced complementary slots formed in the second platen when one of the platens is moved towards the other platen. The first platen is pivoted to the second platen on pins and the spring means are coil springs that are received within an upstanding boss in the lower platen and engage the undersurface of the upper platen thereby normally biasing the upper and lower platens away from one another.

SUMMARY OF THE INVENTION

In view of the above, it is an object of the present invention to provide a paper slitting device which comes within the scope of U.S. Pat. No. 4,879,932, but which has fewer parts, thus making it easier and cheaper to manufacture. Other objects and features of the invention will be in part apparent and in part pointed out hereinafter.

In accordance with the invention, a manually operable paper slitting device for slitting a sheet of paper has first and second pivotally mounted platens having spring means interposed therebetween for biasing the platens apart. The first platen has spaced slitting blades for cutting the paper and the second platen has spaced complementary slots for receiving the slitting blades when one of the platens is moved towards the other platen.

The spring means has a resilient member with a free end extending from the first platen toward the second platen. The resilient member forms a bearing for the first platen about an axis and the resilient member is received in a slot in the second platen. The slot has a wall against which the free end of resilient member is stopped biasing the platens apart in an at rest position. The resilient member bends when a force is applied to one of the platens sufficient to move the one platen toward the other platen and then return the one platen to the at rest position when the force is removed.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
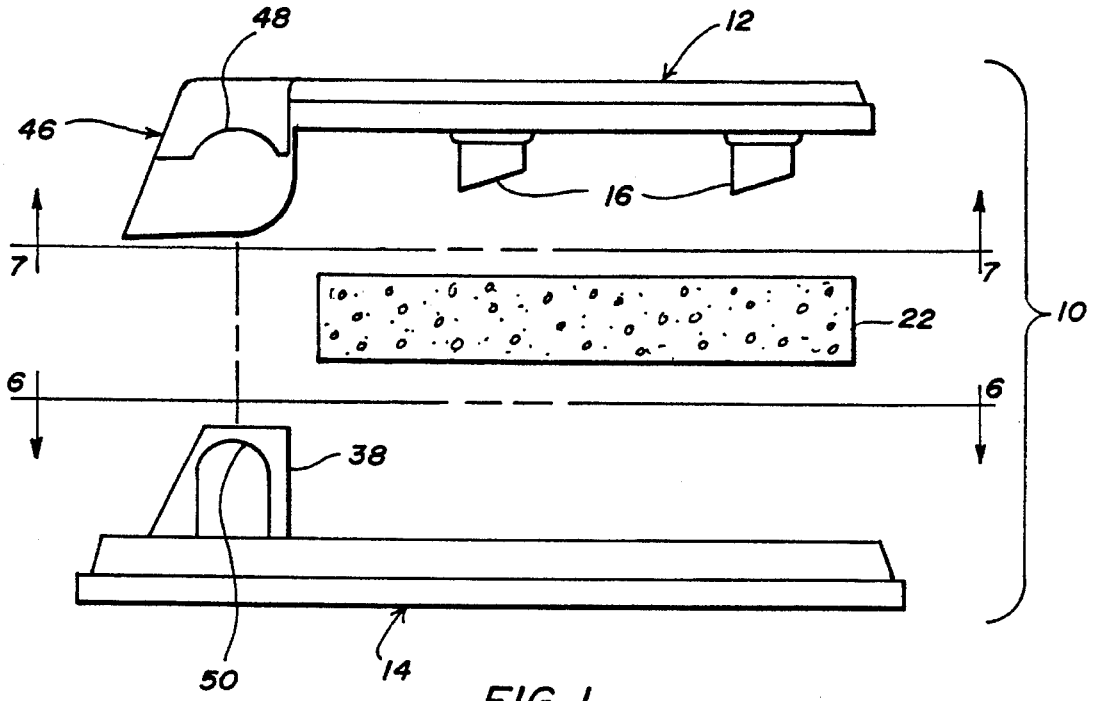
FIG. 1 is an exploded side elevation of a paper slitting device in accordance with the present invention.
Figure 2:
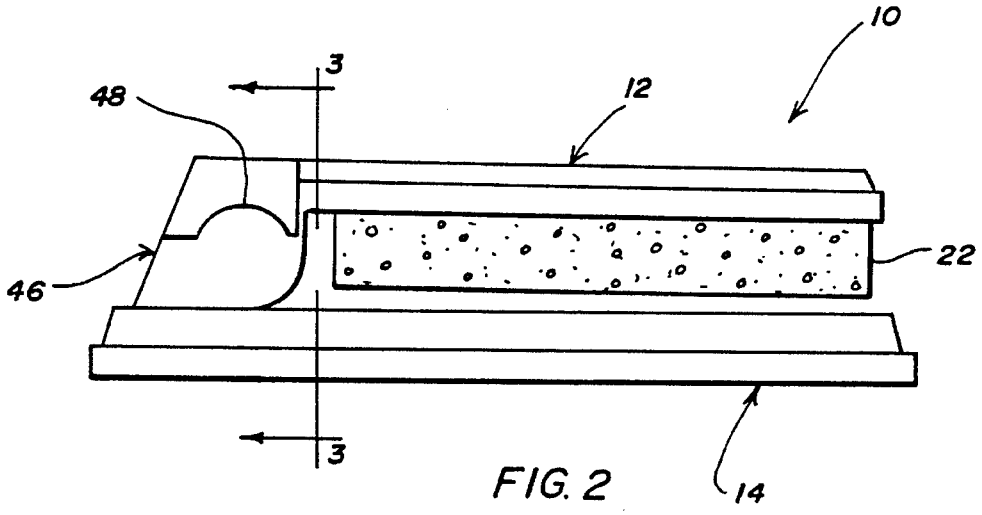
FIG. 2 is a side elevation of the paper slitting device shown in FIG. 1.

Referring to the drawings more particularly by reference character, as shown in FIGS. 1–2 and 6–7, a manually operable paper slitting device 10 in accordance with the present invention includes first and second pivotally mounted platens 12, 14, respectively. A pair of spaced slitting blades 16 extend from first platen 12 toward the second platen 14. Second platen 14 has spaced complementary slots 18 for receipt of the slitting blades when one of the platens is moved towards the other platen. A spring means 20 is interposed between first and second platens 12, 14 for normally biasing the platens away from each other. A resilient and compressible paper hold down and stripper element 22 extends from first platen 12 toward the second platen 14 and surrounds spaced slitting blades 16.

Figure 3:
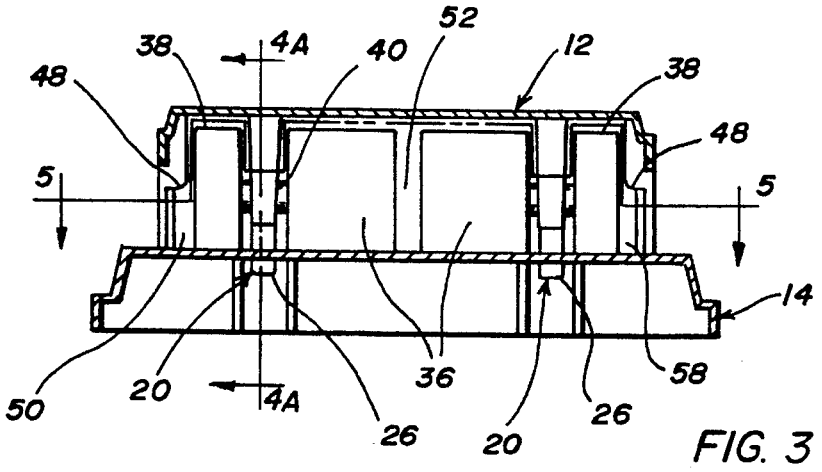
FIG. 3 is a section taken along line 3—3 in FIG. 2.
Figure 4A:
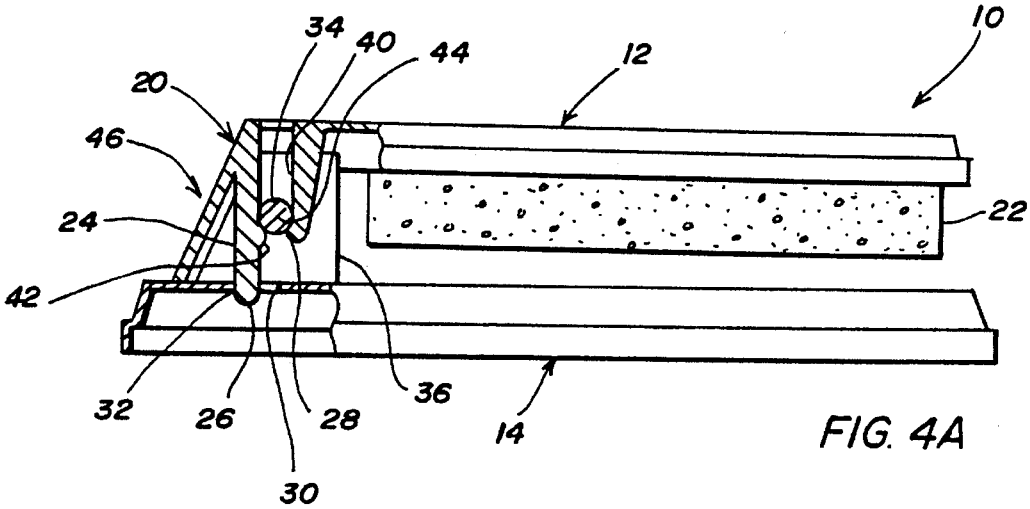
FIG. 4A is a section taken along line 4A—4A in FIG. 3.
Figure 4B:
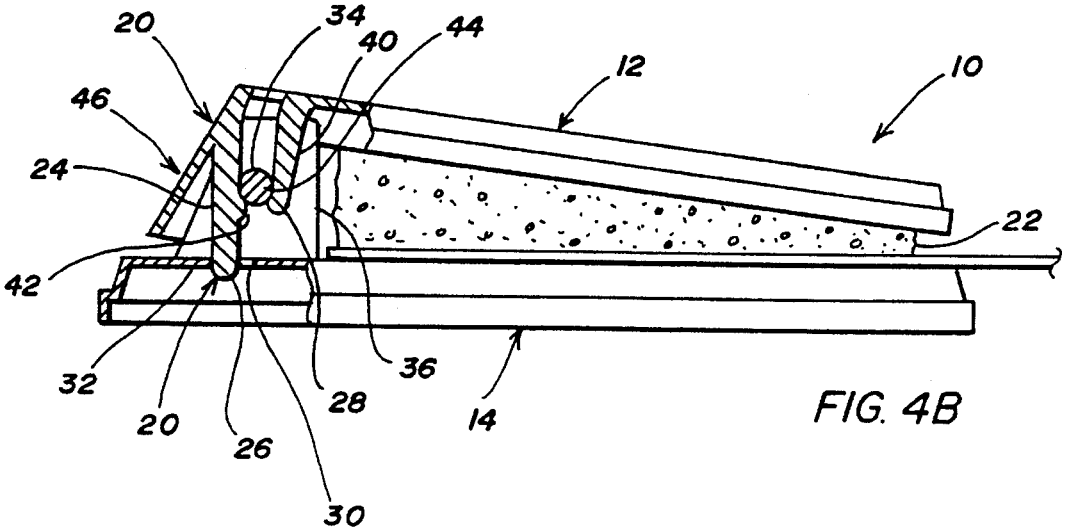
FIG. 4B is a section similar to 4A after a force has been applied to the upper platen sufficient to move it toward the lower platen.
Figure 5:
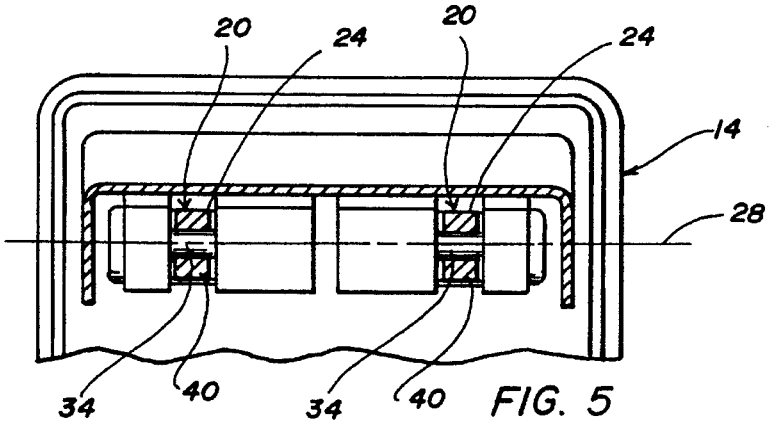
FIG. 5 is a fragmentary section taken along line 5—5 in FIG. 3.

As best seen in FIGS. 3–5, spring means 20 includes a resilient member, illustrated as a pair of resilient fingers 24, mounted near one end of first platen 12. Each finger 24 has a free end 26 extending from the first platen toward the second platen. Fingers 24 form a bearing for first platen 12 about an axis 28 that is generally transverse to a long axis of the fingers. A slot 30 is provided along a corresponding side edge of second platen 14 for receipt of each finger 24. Each of slots 30 has a sidewall 32 against which free end 26 of fingers 24 is stopped biasing the platens apart in an at rest position. When a force is applied to one of said platens sufficient to move the one platen towards the other platen, fingers 24 bend and, when the force is removed, straighten, returning the one platen to the at rest position.

Figure 6:
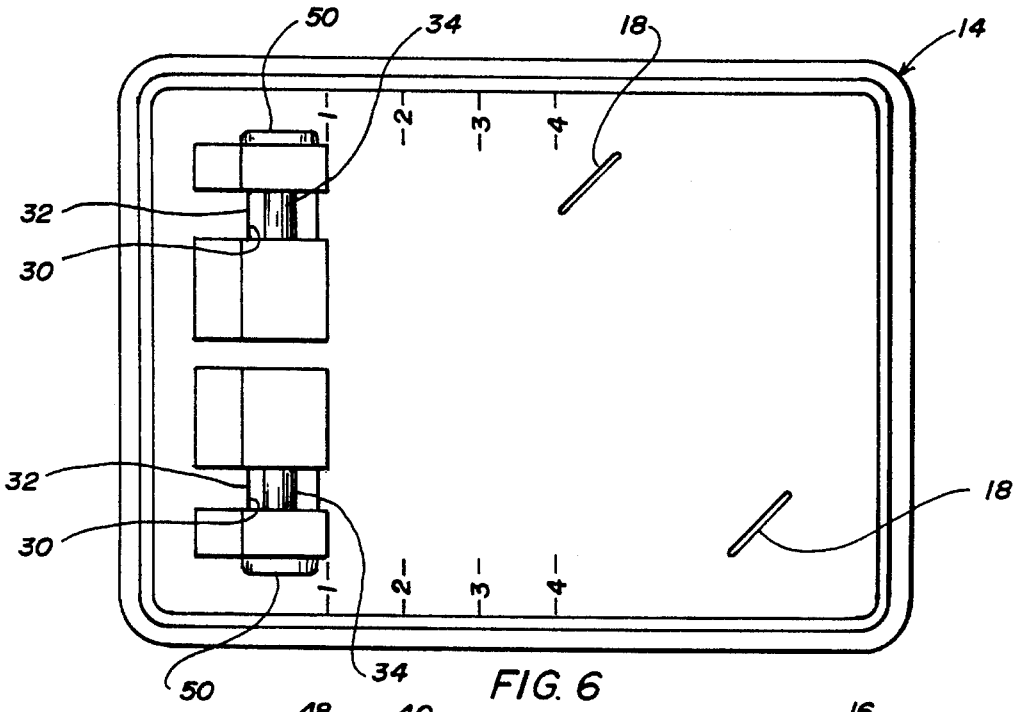
FIG. 6 is a top view of the lower platen taken in the direction of line 6—6 in FIG. 1; and, FIG. 7 is a bottom view of the upper platen taken in the direction of line 7—7 in FIG. 1.
Figure 7:
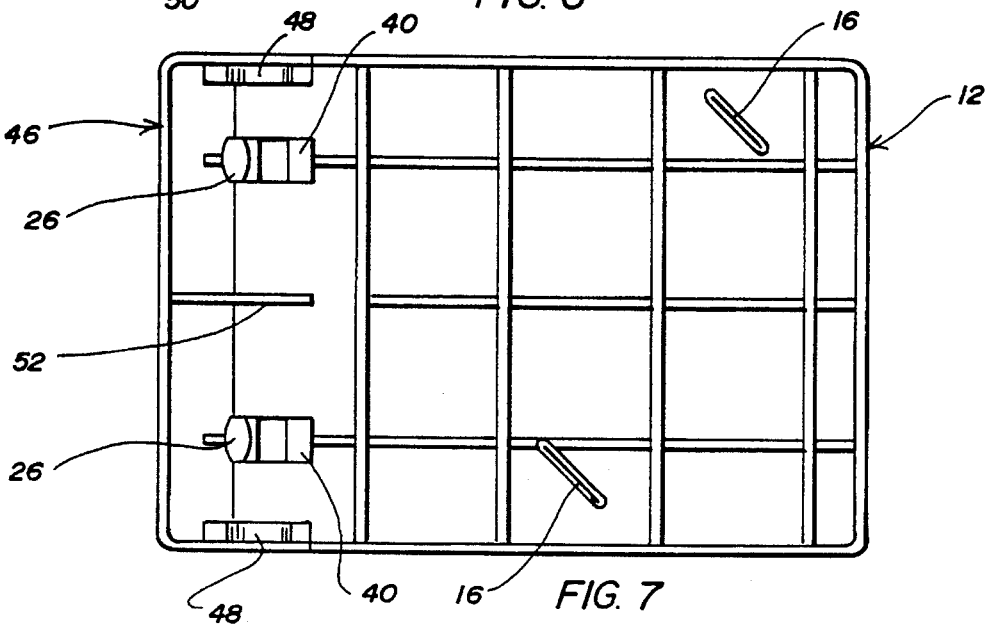

As best seen in FIGS. 5 and 6, axis 28 is formed by a pair of fixed axles 34 mounted in line above slots 30 between inner and outer bosses 36, 38 at one end of second platen 14. Upper platen 12 is hinged to lower platen 14 by axles 34 which are pinched between fingers 24 and a second pair of shorter, resilient fingers 40 provided for that purpose. Fingers 40, like fingers 24, have a free end extending from first platen 12 toward second platen 14. Unhinging of upper platen 12 is resisted, as shown in FIGS. 4A and 4B, by means of a detent 42 which is formed along fingers 24 and a cooperating, opposing hook 44 which is formed on shorter fingers between which axles 34 are held. A skirt 46 depends from upper platen 12 at hinged end, cupping bosses 36, 38 with inner side portions of skirt 46 curved at 48 to ride on complementarily curved cheeks 50 of outer bosses 38. A reinforcing rib 52 interconnects skirt 46 to upper platen 12 and passes between inner bosses 36, stabilizing the assembly.

In use, manually operable paper slitting device 10 forms a pair of generally diagonally extending and spaced parallel slits in a paper document. Opposite corners of a business card or the like may then be inserted into the diagonally extending and spaced slits so that it can be conveniently mounted to a paper document and then readily removed, when desired. The present invention is an improvement on U.S. Pat. No. 4,879,932. As in our earlier Pat., the term "paper" or "paper document" includes a single sheet of paper or multiple sheets of paper or paper having various shapes, sizes and thickness, including cardboard or corrugated sheets. Also, the shape, size and location of the diagonally extending and spaced parallel slits may be varied to suit the particulars desired.

When a predetermined force is downwardly applied by hand against upper platen 12, starting from an at rest position as shown in FIG. 4A, fingers 24 form a bearing for upper platen 12 about axles 34. As upper platen 12 is depressed, fingers 24, 40 rotate about axles 34 until the free end 26 of fingers 24 is stopped by sidewall 32 of slots 30. Further pressure on upper platen 12 causes fingers 24 to bend and shorter fingers 40 to slide down on axles 34 as best seen in FIG. 4B. When the downward force is removed, fingers 24 straighten, causing shorter fingers 40 to slide up on axles 34 as the upper platen is returned to the at rest position.

Resilient and compressible paper hold down and stripper element 22 collars slitting blades in the at rest position and protects the operator from injury. As a downward force is applied against upper platen 12, resilient and compressible paper hold down and stripper element 22 engages the paper document prior to and during the slitting operation, in order to prevent any shifting of the paper. When the downward force is removed, the resilient and compressible paper hold down and stripper element 22 pushes the paper off slitting blades 16, in the event of any hang up, allowing the paper to be withdrawn from manually operable paper slitting device 10 without difficulty.

It will be understood that the overall size, shape, appearance and material used (plastic, metal, composite, etc.) may be varied, without changing the essential features and operation of manually operated paper slitting device 10 described above. In a preferred form upper and lower platens 12, 14 are formed of plastic with fingers 24, 20 integrally formed in first platen 12 and slots 30 and axles 34 integrally formed in second platen 14. Paper slitting device 10 is assembled by slipping compressible paper hold down and stripper element 22 over slitting blades 16 and attaching it to the underside of upper platen 12. Fingers 24, 40 are then snapped over axles 34.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A manually operable paper slitting device for slitting at least one individual paper sheet comprising first and second pivotally mounted platens having spring means interposed therebetween for normally biasing said platens away from each other, said first platen having spaced slitting blades extending from the first platen toward the second platen, said second platen having spaced complementary slots for receipt of the slitting blades when one of the platens is moved toward the other platen, said spring means comprising a first pair of resilient fingers, each of said first fingers having a free end extending from the first platen toward the second platen, said first fingers forming a bearing for the first platen about an axis, said first fingers received in slots in the second platen, said slots having a wall against which the free ends of the first fingers are stopped biasing the platens apart in an at rest position, said first fingers bending when a force is applied to one of said platens sufficient to move the one platen toward the other platen, said first fingers returning the one platen to the at rest position when the force is removed.

2. The slitting device of claim 1 wherein the axis is formed by a pair of fixed axles mounted in line at one end of the second platen.

3. The slitting device of claim 2 wherein the spring means further comprises a second pair of shorter, resilient fingers and wherein the axles are pinched between the first fingers and the second fingers, each of said second fingers having a free end extending from the first platen toward the second platen.

4. The slitting device of claim 3 wherein a skirt depends from the first platen toward the second platen shielding the first and second fingers from view.

5. The slitting device of claim 3 wherein each of the first fingers has a detent facing the second fingers and each of the second fingers have an opposing hook, said detents and hooks cooperating for resisting unsnapping of the axles from between the first and second fingers.

* * * * *